US007247847B2

(12) United States Patent
Webb et al.

(10) Patent No.: US 7,247,847 B2
(45) Date of Patent: Jul. 24, 2007

(54) MASS SPECTROMETERS AND METHODS OF ION SEPARATION AND DETECTION

(75) Inventors: Brian Christopher Webb, Wiltshire (GB); Donald Clifford Young, Berkshire (GB)

(73) Assignee: ILIKA Technologies Limited, Chilworth, Southampton, Hampshire (GB)

( * ) Notice: Subject to any disclaimer, the term of this patent is extended or adjusted under 35 U.S.C. 154(b) by 0 days.

(21) Appl. No.: 10/480,731

(22) PCT Filed: May 29, 2002

(86) PCT No.: PCT/GB02/02565

§ 371 (c)(1),
(2), (4) Date: May 26, 2004

(87) PCT Pub. No.: WO02/103746

PCT Pub. Date: Dec. 27, 2002

(65) Prior Publication Data

US 2004/0206899 A1 Oct. 21, 2004

(30) Foreign Application Priority Data

Jun. 14, 2001 (GB) ..... 0114548.1

(51) Int. Cl.
*H01J 49/00* (2006.01)

(52) U.S. Cl. ..... 250/293; 250/281; 250/288; 250/290

(58) Field of Classification Search ..... 250/287, 250/288, 292
See application file for complete search history.

(56) References Cited

U.S. PATENT DOCUMENTS 2,633,539 A 3/1953 Altar
4,458,149 A * 7/1984 Muga ..... 250/287

(Continued)

FOREIGN PATENT DOCUMENTS

WO 83/00258 1/1983

OTHER PUBLICATIONS

Yu, W. et al. "Enhancement of Ion Transmission at Low Collision Energies via Modifications to the Interface Region of a Four-Sector Tandem Mass Spectrometer". *Journal of the American Society for Mass Spectronomy*. (May 1994): 460-469.

(Continued)

*Primary Examiner*—David A. Vanore
(74) *Attorney, Agent, or Firm*—Renner, Otto, Boisselle, & Sklar, LLP

(57) ABSTRACT

A mass spectrometer comprises an ion source which provides a beam of ions; a mass filter comprising a pair of electrodes and a drive circuit, the drive circuit operable to apply a time varying voltage to the electrodes having a profile that accelerates the ions to equal velocities irrespective of their mass: charge ratios; and an ion detector for detecting the proportions of ions according to their mass-to-charge ratios. In one embodiment, the voltage profile is exponential. In another embodiment, the voltage profile is a sequence of constant amplitude and increasing repetition frequency pulses. The novel mass filter thus imparts equal velocities to all ion species irrespective of their mass. This allows the ion species to be discriminated at the detector by energy, enabling simple and compact detection schemes to be used.

22 Claims, 7 Drawing Sheets

U.S. PATENT DOCUMENTS

| | | | | |
|---|---|---|---|---|
| 5,420,423 | A | 5/1995 | Linden | |
| 5,504,326 | A | 4/1996 | Reilly et al. | |
| 5,905,259 | A | 5/1999 | Franzen | |
| 6,229,142 | B1 * | 5/2001 | Bateman et al. | 250/287 |
| 6,438,010 | B1 * | 8/2002 | Pease | 363/147 |
| 6,441,369 | B1 * | 8/2002 | Vestal et al. | 250/287 |

OTHER PUBLICATIONS

Birkinshaw, K. "Advances in multi-detector arrays for mass spectrometry—a LINK (JIMS) project to develop a new high-specification array". *Transactions of the Institute of Measurement and Control*. 16.3 (1994): 149-162.

Birkinshaw, K. "Focal Plane Charge Detector for Use in Mass Spectrometry". *Analyst*. 117 (1992):1099-1104.

* cited by examiner

MASS SPECTROMETERS AND METHODS OF ION SEPARATION AND DETECTION

This application is a national phase of International Application No. PCT/GB02102565 filed May 29, 2002 and published in the English language. cl BACKGROUND OF THE INVENTION The invention relates to mass spectrometers and also to methods of ion separation and ion detection for use with mass spectrometers.

A mass spectrometer is capable of ionising a neutral analyte molecule to form a charged parent ion that may then fragment to produce a range of smaller ions. The resulting ions are collected sequentially at progressively higher mass/charge (m/z) ratios to yield a so-called mass spectrum that can be used to "fingerprint" the original molecule as well as providing much other information. In general, mass spectrometers offer high sensitivity, low detection limits and a wide diversity of applications.

Mass spectrometers comprise three main components that are connected serially, as illustrated in FIG. 1. The main components of the mass spectrometer 10 are an ion source 12, a mass filter 14 (sometimes referred to as an analyser) and an ion detector 16. The ion source 12 causes neutral molecules M to become ionised to form ions $M_1^+$, $M_2^+$ etc. Both positive and negative ions may be used, although positive ion mass spectroscopy is much more common. The ions are separated on the basis of their m/z ratios, typically in the mass filter. The separated ions are then accumulated by the ion detector 16, which converts the collected charge to a signal current I. The signal current I is used to produce the mass spectrum 18, which is a plot of current versus m/z ratio, and in effect shows the proportions of ions having particular m/z ratios.

The basic arrangement shown in FIG. 1 has many variants. Types of mass filter currently available include:

a) the magnetic sector type, which may be room-sized;
b) the quadrupole type, which is based on a filter, and has dimensions of typically 25 cm;
c) the time of flight type, which relies on a drift tube typically of the order of 1 m in length, or half that if a reflectron is used;
d) the ion trap type; and
e) the Fourier transform ion cyclotron resonance type.

Each of these types of mass filter uses the action on the ions of magnetic fields, electric fields, or a combination of both, to separate the charged ions according to their m/z ratios. The charged ions may be multiply charged. The fields may be time invariant (steady), ramped, pulsed or oscillating. Ions are separated from each other either temporally, spatially, or both. In a time of flight spectrometer, for example, the field(s) serves to impart different velocities to ions having different m/z ratios, thereby to allow subsequent discrimination and detection of the different ion species by the ion detector.

A time of flight mass spectrometer, such as disclosed in WO 83/00258 [1], has a mass filter that spatially separates ions of different m/z ratios. A drift tube is included to achieve ion separations that are sufficient for accurate temporal resolution at the detector. The length of the drift tube makes the spectrometer bulky, but it allows a compact detection arrangement to be used.

SUMMARY OF THE INVENTION

A first aspect of the present invention is directed to a mass spectrometer comprising:

an ion source for providing an ion beam comprising a plurality of ions, each having a mass-to-charge ratio;

an ion detector arranged to receive the ion beam and operable to detect the ions according to their mass-to-charge ratios; and a mass filter arranged between the ion source and the ion detector, the mass filter comprising an electrode arrangement and a drive circuit, the drive circuit being configured to apply a time varying voltage profile to the electrode arrangement so as to accelerate the ions to nominally equal velocities irrespective of their mass-to-charge ratios.

A mass spectrometer of this construction does not require a bulky drift tube to separate the ions spatially. Since the ions are all accelerated to the same velocity, or at least nominally the same velocity, the ions of different mass/charge ratio have different energies owing to their different masses. Therefore, detectors which can distinguish ion species according to their energies can be used to detect the ions. Detectors of this type can be of simple and compact construction. Hence, it is possible to provide a mass spectrometer that combines a simple, compact detector and does not require a bulky additional component such as a drift tube, such as in a time-of-flight mass spectrometer.

Application of an exponential voltage pulse or functional equivalent will, according to a theoretical analysis given in an appendix below, accelerate all ions to the same velocity. However, it will be appreciated that in practice the ions of different mass/charge ratio will not generally be accelerated to precisely the same velocity in view of practical considerations and also taking account of assumptions made by the theoretical analysis. The term nominally equal velocities is therefore used to express the design principle of the device, which is completely different from the conventional approach, and to avoid giving the misleading impression that the design aim of accelerating all ions to precisely equal velocities is, or needs to be, fulfilled in a practical device.

A mass filter for accelerating ions of any mass-to-charge ratio to the same velocity can be made very much smaller than known mass filters. Typically, a mass filter having dimensions of only a few centimetres can be made. Being able to provide a mass spectrometer of smaller dimensions is advantageous in its own right, as regards, for example, cost, ease of use and maintenance, and portability. Moreover, a smaller, shorter device means that lower vacuums, i.e. higher operating pressures, are possible. This is because a lower mean free path of the ions in the device can be tolerated. In practical terms, this allows the use of smaller and cheaper vacuum pumping systems.

In one embodiment, the time varying voltage profile comprises an exponential voltage pulse.

In another embodiment, the time varying voltage profile comprises a sequence of voltage pulses having an exponentially increasing repetition frequency. Preferably the voltage pulses have substantially equal amplitude.

The drive circuit may be an analogue or digital drive circuit. An analogue drive circuit may comprise a low voltage analogue circuit and a step-up transformer. A digital drive circuit may comprise two or more digital wave form generators connected in parallel.

The ion source may comprise a pulse generator for generating the ion beam as a series of packets, i.e. pulses.

The ion detector in one group of embodiments comprises a detector element and an ion disperser to disperse the ions over the detector element according to their mass-to-charge ratios. In one embodiment of this group, the ion detector comprises a detector array and an ion disperser to disperse the ions over the detector array according to their mass-to-charge ratios. Preferably, the ion disperser comprises electrodes that produce a curved electric field which deflects the ions onto the array by amounts depending on their energies, which in turn depend on their mass-to-charge ratios. Ion detectors of this type offer the advantage of high ion collection efficiencies, as ions are not reflected back from the detector. They also offer fast spectrum collection in the order of microseconds. As an alternative to a detector array, a single element detector can be used in combination with a slit. An ion disperser is then used to route ions through the slit according to their mass-to-charge ratios. With a thin detector, it may be possible to dispense with the slit. Use of a slit may also be beneficial when a detector array is employed.

In another embodiment, the ion detector comprises a first detector electrode, a second detector electrode and a voltage supply operable to bias the first and second detector electrodes with a summation of the time varying voltage profile applied to the electrode arrangement of the mass filter and a bias voltage $V_r$ sufficient to reject ions having an energy of less than $V_r$ electron volts. This configuration allows for a simple linear construction of the mass spectrometer, and also permits the spectrometer to be very small, of the order of 10 cm in length or less.

In a modification of the embodiment just described, the ion detector comprises a first detector electrode and a voltage supply operable to bias the first detector electrode with a summation of the time varying voltage profile applied to the electrode arrangement of the mass filter and a bias voltage $V_r$ sufficient to reject ions having an energy of less than $V_r$ electron volts. In this embodiment, a second electrode is not needed, since the ion energy scanning is performed by sweeping the voltage on the first electrode on which the ions are incident.

A second aspect of the present invention is directed to a method of accelerating ions within a mass spectrometer, the method comprising: generating an ion beam comprising a plurality of ions, each having a mass-to-charge ratio; supplying the beam of ions in packets to a mass filter region defined by an electrode arrangement; and applying a time varying voltage profile to the electrode arrangement so as to accelerate the ions passing through the mass filter region to nominally equal velocities irrespective of their mass-to-charge ratios.

A third aspect of the present invention is directed to a mass filter, comprising an electrode arrangement and a drive circuit, the drive circuit being configured to apply a time varying voltage profile to the electrode arrangement so as to accelerate ions passing through the mass filter to nominally equal velocities irrespective of their mass-to-charge ratios.

BRIEF DESCRIPTION OF THE DRAWINGS

For a better understanding of the invention and to show how the same may be carried into effect reference is now made by way of example to the accompanying drawings in which.

DETAILED DESCRIPTION

Figure 1:
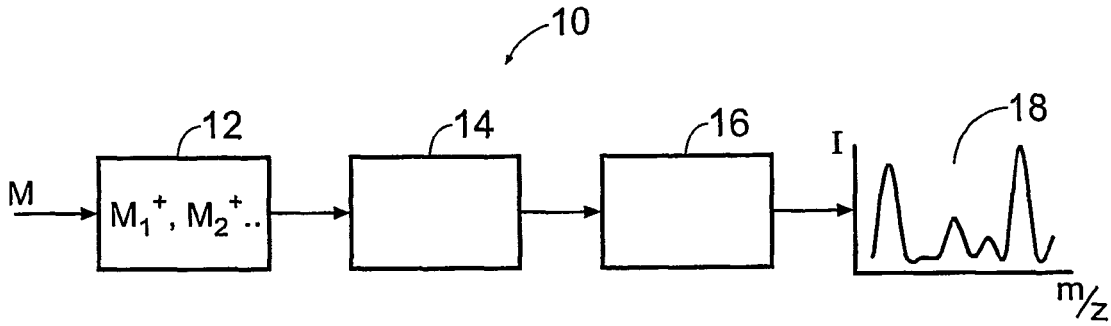
FIG. 1 is a block schematic drawing showing the basic components of a conventional mass spectrometer.
Figure 2:
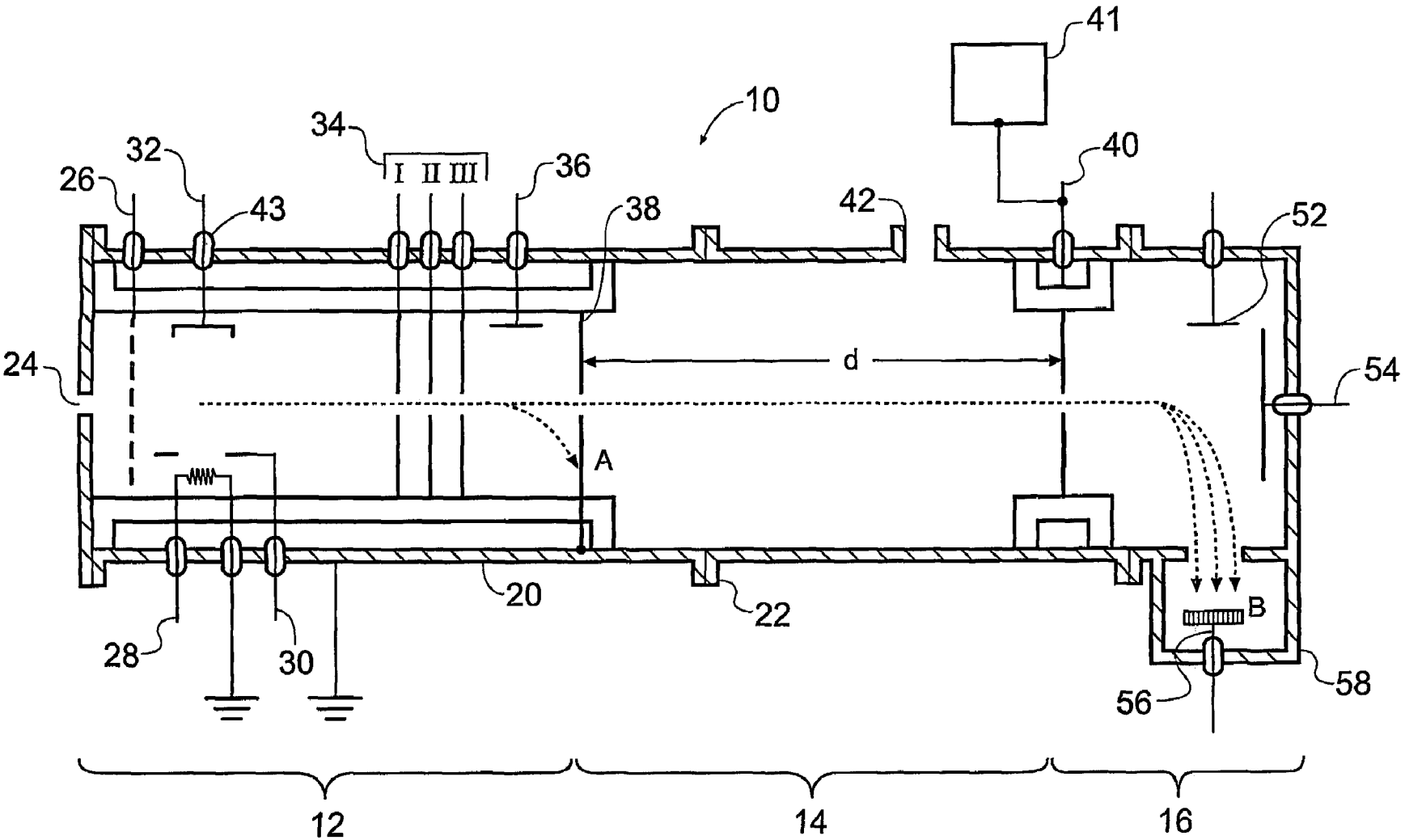
FIG. 2 shows a schematic cross-sectional view of a first embodiment of a mass spectrometer according to the present invention.

FIG. 2 shows a schematic cross-sectional view of a mass spectrometer according to the present invention. The mass spectrometer will be described in terms of spectrometry of a gaseous analyte, but is equally applicable to non-gaseous analytes, such as liquid or solid analytes.

A mass spectrometer 10 has a body 20 formed primarily from stainless steel sections which are joined together by flange joints 22 sealed by O-rings (not shown). The body 20 is elongate and hollow. A gas inlet 24 is provided at one end of the body 20. A first ion repeller electrode 26 having a mesh construction is provided across the interior of the body 20, downstream of the gas inlet 24. The mesh construction is highly permeable to gas introduced through the gas inlet 24, but acts to repel ions when an appropriate voltage is applied to it.

An ioniser comprising an electron source filament 28, an electron beam current control electrode 30 and an electron collector 32 is located downstream of the first ion repeller electrode 26. The electron source filament 28 and the current control electrode 30 are located on one side of the interior of the body 20, and the electron collector 32 is located opposite them on the other side of the interior of the body 20. The features operate in the conventional fashion, in that, by the application of appropriate currents and voltages, electrons are generated by the source filament 28, collimated by the control electrode 30, and travel in a stream across the body 20 to the collector 32.

An ion collimator in the form of an Einzel lens 34 is located downstream of the ioniser. Einzel lenses are known in the art for collimating beams of ions [2]. Downstream of the lens 34 is a second ion repeller electrode 36, which is located on one side of the body 20 only, and an first mass filter electrode 38 which is annular and extends across the body 20 and has an aperture for the passage of ions. The first mass filter electrode 38 and the body 20 are both grounded.

The above-mentioned features can be considered to together comprise an ion source 12 which provides ions in a form suitable for being accelerated according to their mass-to-charge ratio.

Situated downstream of the collector electrode 38 is a mass filter 14 comprising an electrode arrangement. The mass filter 14 extends for a length d, between the first mass filter electrode 38 and an exponential pulse electrode 40. The exponential pulse electrode 40 is annular and has an aperture for the passage for ions. A drive circuit 41 is provided for applying time varying voltage profiles to the exponential pulse electrode 40.

An outlet 42 is provided in the part of the body 20 which forms the outer wall of the mass filter. The outlet 42 permits connection of a vacuum system by means of which the pressure in the interior of the mass spectrometer 10 can be reduced to the required operating pressure, typically no higher than $1.3\times10^{-3}$ Pa ($\sim10^{-5}$ torr), which is usual for a mass spectrometer. The outlet 42 may alternatively be situated at the end of the body 20, near the gas inlet 24.

The term "exponential box" is used in the following to refer to the mass filter 14. More specifically, the exponential box 14 can be considered to fill the volume formed between the first mass filter electrode 38 and the exponential pulse electrode 40 (separated by distance d).

Beyond the exponential pulse electrode 40, the mass spectrometer 10 terminates with an ion detector 16. A pair of repeller electrodes 52, 54 is located downstream of the exponential pulse electrode 40. The first electrode 52 is located to the side of the ion path and the second electrode 54 is located at the end wall of the mass spectrometer, effectively in the ion path. The two electrodes 52, 54 are substantially orthogonal, and together form an ion disperser. Other electrode arrangements could also be used. A detector array 56 is provided in a detector box 58. The box 58 is external to the grounded body 20, and has an aperture to allow the passage of ions from the body 20 to the detector array 56. The detector array 56 is located opposite to the first repeller electrode 52. Ion detector arrays are known in the art [3,4]. In the figure, the detector array is shown aligned parallel to the main axis of the instrument. The detector array could be mounted at different angles, depending on the beam deflection angle provided by the repeller electrodes 52, 54.

The electrodes are all mounted on electrode supports 43 which are fabricated from suitable insulator materials such as ceramic.

Operation of the mass spectrometer 10 will now be described.

Gas which is to be analysed is admitted into the interior of the mass spectrometer 10 at low pressure via the gas inlet 24. No means of gas pressure reduction is shown in the Figures, but there are many known techniques available, such as the use of membranes, capillary leaks, needle valves, etc. The gas passes through the mesh of the first ion repeller electrode 26.

The gas is then ionised by the stream of electrons from the electron source filament 28, to produce a beam of positive ions. The electrons are collected at the electron collector 32, which is an electrode set at a positive voltage with respect to the current control electrode 30, to give electrons near the axis of the ion source, shown by the dotted line in FIG. 2, an energy of about 70 eV. This is generally regarded as being about the optimum energy for electron impact ionisation, as most molecules can be ionised at this energy, but it is not so great as to produce undesirable levels of fragmentation. The precise voltage applied to the electron collector 32 would normally be set by experiment but will probably be of the order of 140 V assuming that the current control electrode 30 is earthed. It should be appreciated that there are many possible designs of electron impact ionisation source and, indeed, other methods of causing ionisation. The method and construction described herein and illustrated in the accompanying drawings is merely a preferred embodiment.

Any gas which is not ionised by the stream of electrons will pass through the mass spectrometer 10 and be pumped away by the vacuum system connected to the outlet 42. A flanged connection is suitable.

The dotted line referred to above also indicates the passage of ions through the mass spectrometer 10. A positive voltage is applied to the first ion repeller electrode 26, to repel the (positive) ions and direct them through the Einzel lens 34 so as to produce a narrow, parallel ion beam. A positive voltage is applied to the second ion repeller electrode 36, so that the ion beam is deflected by the second ion repeller electrode 36. The deflected ions, which follow the dotted path labelled 'A' in FIG. 2, are collected at the first mass filter electrode 38, which is grounded to prevent build-up of space charge.

To allow ions to enter the mass filter, the voltage on the second ion repeller electrode 36 is periodically set to 0 V to allow a small packet of ions to be undeflected so that they enter the exponential box 14 through the aperture in the first mass filter electrode 38. In this way, the second ion repeller electrode 36 and the first mass filter electrode 38 form a pulse generator for generating packets of ions.

At the moment at which the ion packet enters the exponential box 14, an exponential voltage is applied to the exponential pulse electrode 40 by the drive circuit 41. Alternatively, it may be advantageous in some implementations to delay application of the exponential voltage until a short time after the ion packet enters the exponential box 14, for example a few nanoseconds. The exponential pulse is of the form $V_t=V_0 \exp(t/\tau)$ with respect to time t where $\tau$ is the time constant. The maximum voltage is designated as $V_{max}$. (Since the ions are, in this case, positively charged, the exponential pulse will be negative going. It would need to be positive going in the case of negatively charged ions.) The effect on the ions of the exponentially increasing electric field resulting from the voltage pulse is to accelerate them at an increasing rate towards the exponential pulse electrode 40. Ions with the smallest mass have the lowest inertia and will be accelerated more rapidly, as will ions bearing the largest charges, so that ions with the lowest m/z ratios will experience the largest accelerations. Conversely, ions with the largest m/z ratios will experience the smallest accelerations. After t seconds all of the ions have travelled at least the distance d and passed the exponential pulse electrode 40, at which point the exponential voltage pulse ceases. Also, after time t seconds, all of the ions are travelling with the same velocity $v_t$ mm $s^{-1}$, where $v_t=d/\tau$, but they are spatially separated. This is a particular consequence of an exponentially increasing voltage pulse, whereby if the electrode spacing d and the shaping and timing of the voltage pulse are correctly chosen, the velocity of all the ions is the same as they leave the exponential box, regardless of the mass of the ions. The mathematical derivation of this is given in the appendix to this description. Hence, the ions are separated spatially according to their m/z ratios, with the lightest ions leading as these have experienced the greatest acceleration and have therefore travelled through the distance d most quickly, but all have the same velocity. Because the ions have different masses, they have different kinetic energies. The kinetic energy is given by the well-known equation $E=mv^2/2$, so that the kinetic energy is simply proportional to the mass, given that the velocities are all equal. Therefore, the exponential box 14 acts to distinguish the ions according their m/z ratios, by giving them different energies, but equal velocities. This is in contrast to time of flight mass spectrometers, for example, that impart the same kinetic energy to all ions of the same charge irrespective of mass.

The exponential box has been described as accelerating all ions to an equal velocity. In practice, the ions will typically have a range of velocities, arising from any imperfections in the system. A spread of velocities of the order of 1% can typically be expected to be achieved, which has a negligible detrimental effect on the final results from the spectrometer. Indeed, meaningful results can be obtained for larger velocity spreads than this, up to spreads of about 10%.

Typically, the distance d can be of the order of a few centimetres. For example, if d is chosen to be 3 cm, and the highest m/z ratio ions present have an m/z of 100 Th, then an exponential pulse with a time constant $\tau$ of 0.77 μs needs to be applied for 5.69 μs to allow those ions to travel the distance d. This gives a peak voltage at the end of the pulse of −1.573 kV.

The precise values of the voltages which need to be applied to the various electrodes depends on the exact geometry adopted in the mass spectrometer 10. An example of a set of suitable voltages is as follows:

| | |
|---|---|
| Ion repeller electrode | +10 V |
| Electron collector | +140 V |
| Einzel lens I | +5 V |
| II | +3 V |
| III | +4 V |
| Ion repeller electrode | +60 V |

An optimised spectrometer design must not permit significant relative movement of the first mass filter electrode 38 and the exponential pulse electrode 40 as a consequence of thermal expansion; the distance d is very critical, and preferably needs to be fixed to better than $10^{-6}$ meters to achieve optimal resolution. The body 20 of the mass spectrometer preferably includes some form of compensation to combat the effects of thermal expansion. For example, the electrodes can be mounted on ceramic sections which are not greatly prone to thermal expansion. It will be appreciated that there is an infinite number of geometric arrangements possible, that is, d can assume any value depending on $V_{max}$ and the exponential time constant τ.

Once the ions have left the exponential box, they must be detected according to their m/z ratio, so that the mass spectrum for the gas can be derived.

As the exponential box 14 accelerates ions to a nominally constant velocity irrespective of m/z, ion energies will be proportional to m/z, so that the ion detector 16 can operate by differentiating between the ions on the basis of their energy. This approach is different from that used in conventional mass spectrometers, for example time of flight mass spectrometers which employ an ion detector that differentiates between ions of different mass on the basis of their different velocities.

The ion detector 16 shown in FIG. 2 operates as follows:

Steady positive voltages are applied to the repeller electrodes 52, 54, which create a curved electric field. As the ions leave the exponential box 14, they enter this curved field, which acts to deflect the ions towards the detector array 56, where they are detected. The amount of deflection, and hence the ion trajectories through this field, will be determined by the energy of the ions, and they will therefore be dispersed over the detector array 56 according to their m/z ratios. The geometric arrangement of the repeller electrodes 52, 54, and the voltages applied to them, together determine the range of m/z ratios that can be detected and the resolution that is achieved. The mass spectrum is obtained from the detector array signal in a conventional manner.

A suitable voltage to be applied to the repeller electrodes 52, 54 is of the order of +400 V with respect to the exponential pulse electrode 40. However, the voltages required to be applied to the repeller electrodes 52, 54 depends upon their exact size, shape and placement in a working device. Values between +300 V and +500 V, or outside that range, may be used in different situations. The figure of +400V should be seen therefore as illustrative only. Moreover, negative values will of course be used if the polarities are reversed.

While a result can be obtained for a single ion packet with this ion detector 16, successive packets can be accumulated so as to improve the signal to noise ratio and, thereby, the sensitivity of the spectrometer. Alternatively this ion detector can be used to obtain time-resolved data.

Figure 2A:
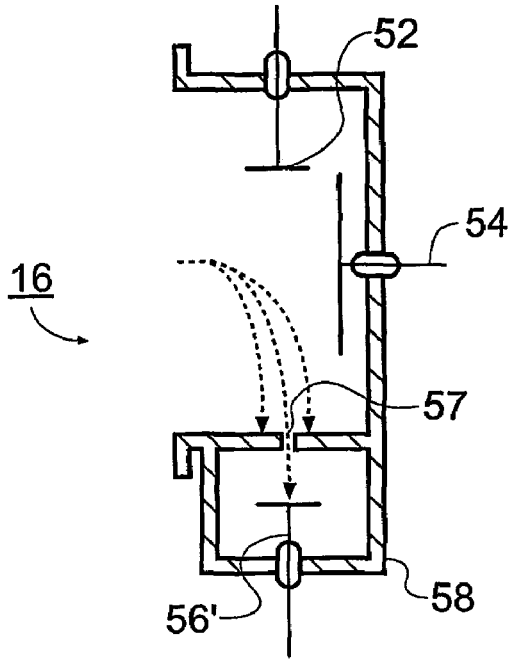
FIG. 2A shows a schematic cross-sectional view of a modified ion detector according to a variant of the first embodiment.

FIG. 2A shows a schematic cross-sectional view of a modified ion detector 16 according to a variant of the first embodiment. The ion detector of FIG. 2A can be used in place of the ion detector shown in FIG. 2. The alternative ion detector of FIG. 2A includes a pair of repeller electrodes 52, 54 and a detector 56' in a detector box 58 as described above in relation to FIG. 2. The ion detector of FIG. 2A differs from that of FIG. 2 in that the detector 56' is a single element detector, instead of a detector array, and the ion beam is scanned over a slit 57 arranged in front of the detector 56' by changing the voltages applied to the ion repeller electrodes 52, 24, these voltages collectively defining the energy range of ions that will pass through the slit 57. Ions of the highest energy will require the highest (curved) electrostatic field to bend them so that they pass through the slit onto the detector 56'. The detector 56' can be a Faraday cup or electron multiplier, for example.

Various operational modes are possible with this arrangement. It is possible to scan through a range of m/z values by continuous variation of the voltages on the repeller electrodes 52 and 54, thereby to obtain a mass spectrum of ion current versus m/z. It is also possible to select a particular value of m/z and monitor the ion current produced by this ion with time. It is also possible to scan over selected narrow ranges of m/z.

The voltages which need to be applied to repeller electrodes 52, 54 will be determined by the precise geometric arrangement of the electrodes with respect to the detector and also by the values of d, t and $V_0$ selected as described previously. Optimum voltages should be found by experimentation. However, as a rough guide, for d=3 cm, t=0.77 ms, $V_0$=−1V and to cover the mass range m/z=1 to 120, the expected voltages that need to be applied to the repeller electrodes 52, 54 would be the instantaneous voltage on the exponential pulse electrode 40 plus a voltage ramp which sweeps from +15V to +1000V.

Figure 3:
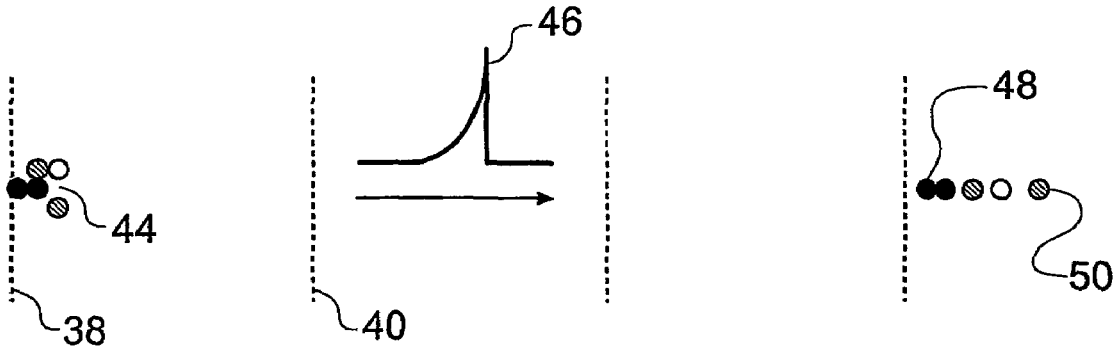
FIG. 3 is a schematic view of ions accelerated in a mass spectrometer according to the present invention.

FIG. 3 illustrates the principle of the exponential box 14 schematically. A packet of ions 44 enters the exponential box at the first mass filter electrode 38, which has a zero applied voltage. The ions then travel to the exponential pulse electrode 40 to which the time varying voltage profile 46 (in this case having the form $V_t=V_0$ exp (t/) which, as previously mentioned, is negative going since the ions are positive) is applied by the drive circuit 41. After passing the exponential pulse electrode, the ions are spatially separated, with the heaviest ion 48 (largest m/z ratio) at the rear and the lightest ion 50 (lowest m/z ratio) at the front.

Figure 4:
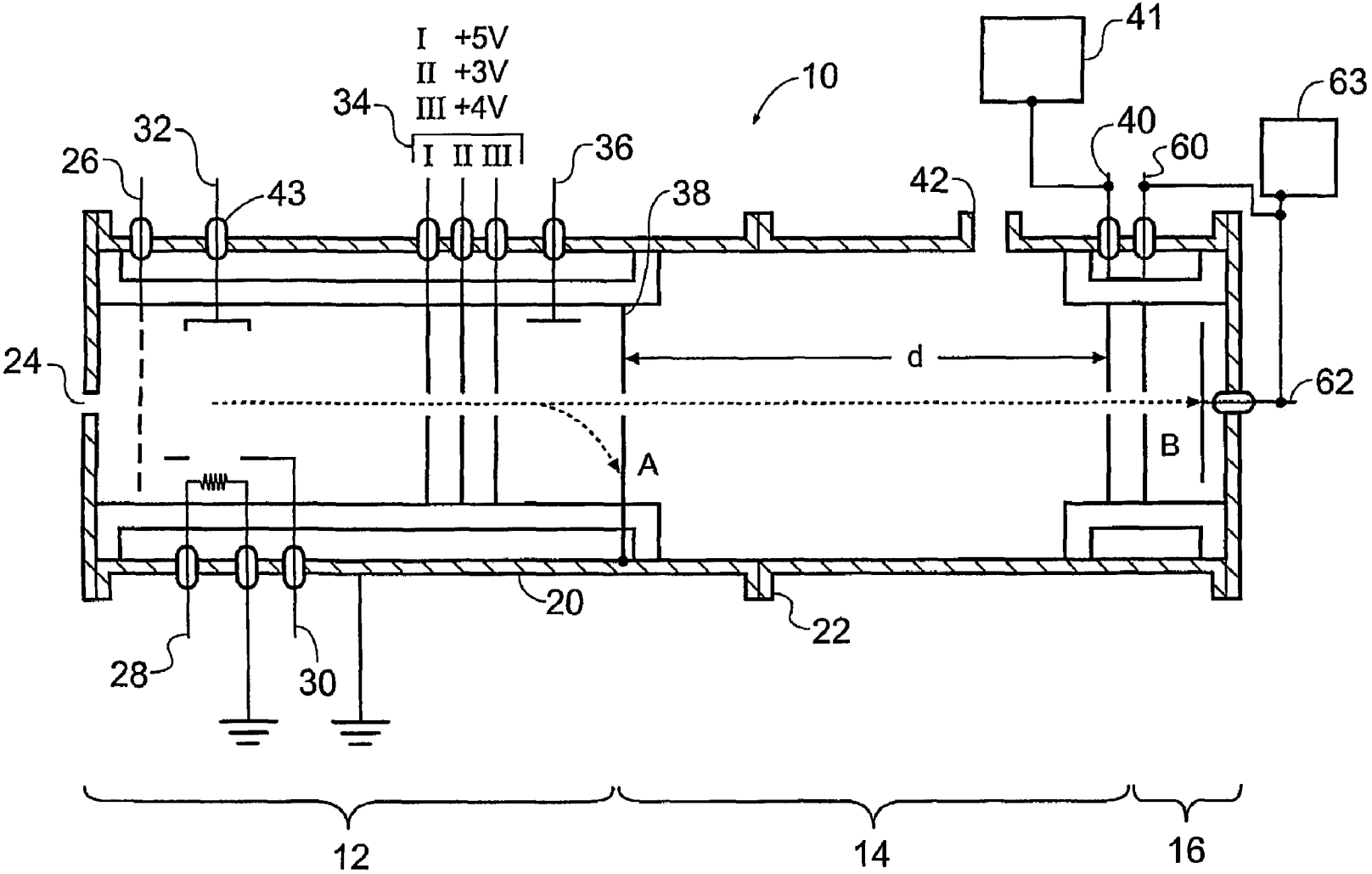
FIG. 4 shows a schematic cross-sectional view of a second embodiment of a mass spectrometer according to the present invention, having an alternative ion detector to that shown in FIG. 2.

FIG. 4 illustrates a further embodiment of the invention which employs a different type of ion detector 16 from that of embodiment shown in FIG. 2. The construction of the ion source 12 and exponential box 14 shown in FIG. 4 are the same as those shown in FIG. 2, and the same reference numerals are used for equivalent parts in FIGS. 2 and 4.

With regard to the ion detector 16 of FIG. 4, downstream of the exponential pulse electrode 40, a first detector electrode 60 is located, which is annular with an aperture for the passage of ions. This electrode 60 acts as an energy selector. Following this, a second detector electrode 62 is located in the ion path. This is in effect a single element detector, and may be, for example, a Faraday cup. A voltage supply 63 is provided for applying voltages to the first detector electrode 60 and the second detector electrode 62.

In use, the first detector electrode 60 and the second detector electrode 62 are set to a potential of $V_t+V_r$ volts, where $V_t$ is the time varying voltage profile as defined above, and $V_r$ is a bias voltage selected to repel, or reflect, ions having energies less than $V_r$ electron volts. Hence, only ions having energies equal to or greater than $V_r$ electron volts pass through the first detector electrode 60 and reach the second detector electrode for detection. An alternative arrangement omits the first detector electrode, so that ions are repelled at the second detector electrode immediately before non-repelled ions are detected.

To obtain a set of mass spectrum data, $V_r$ is initially set to zero, so that all the ions in a packet are detected. For the next packet, $V_r$ is increased slightly to reflect the lowest energy ions, and allow the remainder to be detected. This process is repeated, with $V_r$ increased incrementally for each packet, until the field is such that all ions are reflected and none are detected. The data set of detected signals for each packet can then be manipulated to yield a plot of ion current against m/z ratios, i.e. the mass spectrum.

Alternatively, the ion detection can be carried out by starting with a high value of $V_r$ with repels all the ions. $V_r$ is then reduced for each successive ion packet until $V_r$ is zero and all ions in a packet are detected. Indeed, as long as $V_r$ is swept over a number of different values corresponding to the full range of ion energies, the detection procedure can be carried out in any arbitrary sequence. All that is required is that the complete range of ion energies of interest is covered during the detection procedure. The resolution of this ion detector can be altered as required by changing the number of measurements with different values of $V_r$ which are made. A larger number of measurements over a given ion energy range gives better resolution. Also, it is also possible to set the ion detector to particular voltages, or narrow voltage ranges, in order to concentrate on one or more narrow m/z regions.

Table 1 presents some sample detection data for a range of m/z ratios. This is obtained for an exponential voltage pulse having a time constant of 0.77 μs, exponential box length d=3 cm and $V_0$=−1 V. The table values are calculated using equation (9) of the appendix below with the two constants of integration taken to be zero.)

TABLE 1

| m/z (Th) | Crossing Time (μs) | Velocity ($ms^{-1}$) | Kinetic Energy (eV) | Maximum Exponential Voltage (volts) |
|---|---|---|---|---|
| 1 | 2.12 | $3.90 \times 10^4$ | 7.87 | 15.733 |
| 2 | 2.16 | $3.90 \times 10^4$ | 15.73 | 31.465 |
| 10 | 3.90 | $3.90 \times 10^4$ | 78.66 | 157.33 |
| 30 | 4.74 | $3.90 \times 10^4$ | 236.0 | 471.98 |
| 60 | 5.28 | $3.90 \times 10^4$ | 472.0 | 943.96 |
| 120 | 5.81 | $3.90 \times 10^4$ | 943.9 | 1887.9 |

The data of Table 1 also illustrates how the ions are spatially separated when they leave the exponential box. Values for m/z ratios of up to 120 are given. However, this is for illustration only and it should be appreciated that the invention can also be applied to higher m/z ratios. Despite having the same velocities, the ions with the lowest m/z ratios have the shortest crossing times (this being the time taken to travel the distance d), indicating that they left the exponential box first. This attribute of spatial separation implies that it is also possible to operate a mass spectrometer according to the present invention in a simple non-energy selective mode, in which the spatial separation is used to distinguish between ion species.

There are a number of ways in which the time varying voltage profile can be generated by the drive circuit 41.

Figure 5:
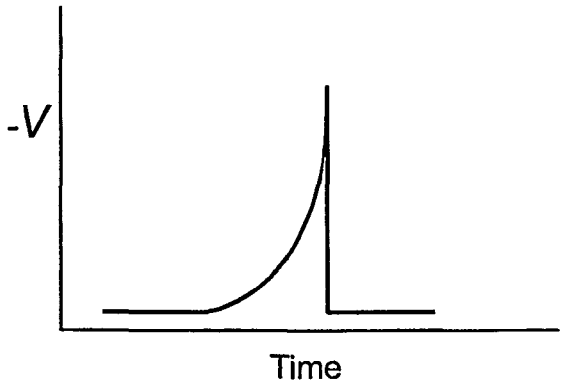
FIGS. 5, 6 and 7 show different functional forms of voltage pulse which may be used to effect the acceleration of the ions.

FIG. 5 shows an analogue exponential pulse, as a graph of voltage against time. Such a pulse may typically be generated by means of a drive circuit 41 comprising a low voltage analogue circuit and a step-up transformer which is necessary to achieve the high voltages required.

Figure 6:
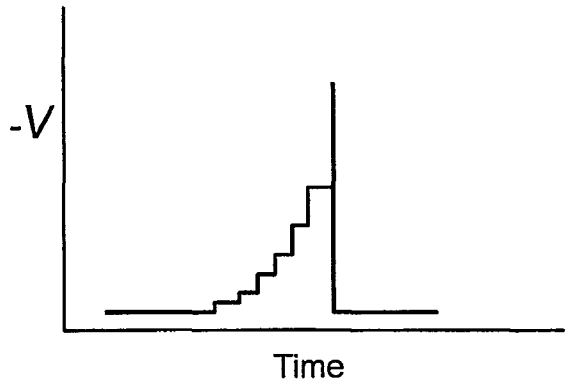

FIG. 6 shows a digitally synthesised exponential pulse, having the step features characteristic of digital signals. This step size needs to be small enough to prevent the ions from "feeling" the individual steps, as this affects the acceleration of the ions, but the intrinsic capacitance of the exponential box will in any case tend to smooth the steps somewhat. A pulse of this type can be generated digitally, for example under hardware or software control, e.g. using a personal computer. For example, the drive circuit 41 can comprise a number of low voltage digital waveform generators connected together in parallel to achieve the necessary high voltages.

Figure 7:
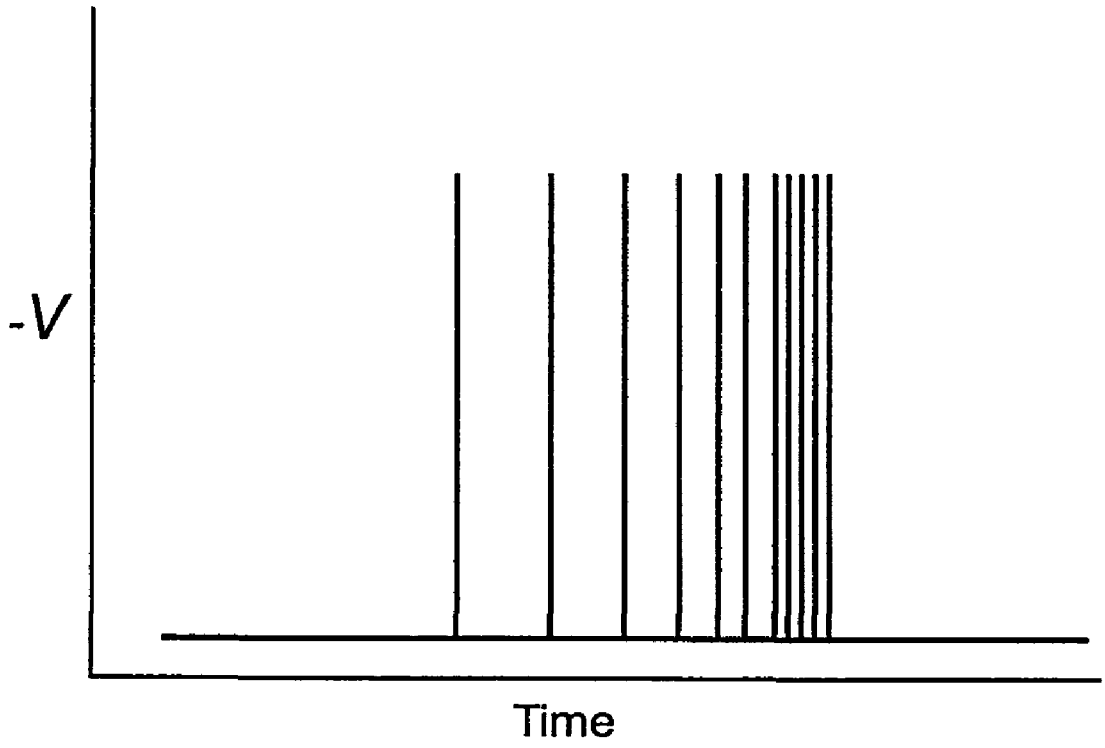

FIG. 7 shows a frequency modulated pulse train of pulses of constant amplitude, short duration, and increasing repetition frequency. The repetition frequency increases exponentially. A series or sequence of pulses of this type gives an effect entirely equivalent to an exponential pulse, because the time average of the pulses corresponds to an exponential pulse. Alternatively, the pulse sequence can have a constant repetition frequency and exponentially increasing pulse amplitude, which also has an exponential time average. However, a pulse sequence of this type can be more complex to produce than one having constant pulse amplitude. Preferably the pulses are square wave pulses, although, as is well-known, it is not possible to generate perfect square wave pulses, especially of high amplitude and short generation. This will have a detrimental effect on the resolution achievable, but on the other hand, use of a pulse train may be advantageous in circumstances where the electronics required for frequency modulation are more readily achievable than those for generating exponential pulses.

Figure 8:
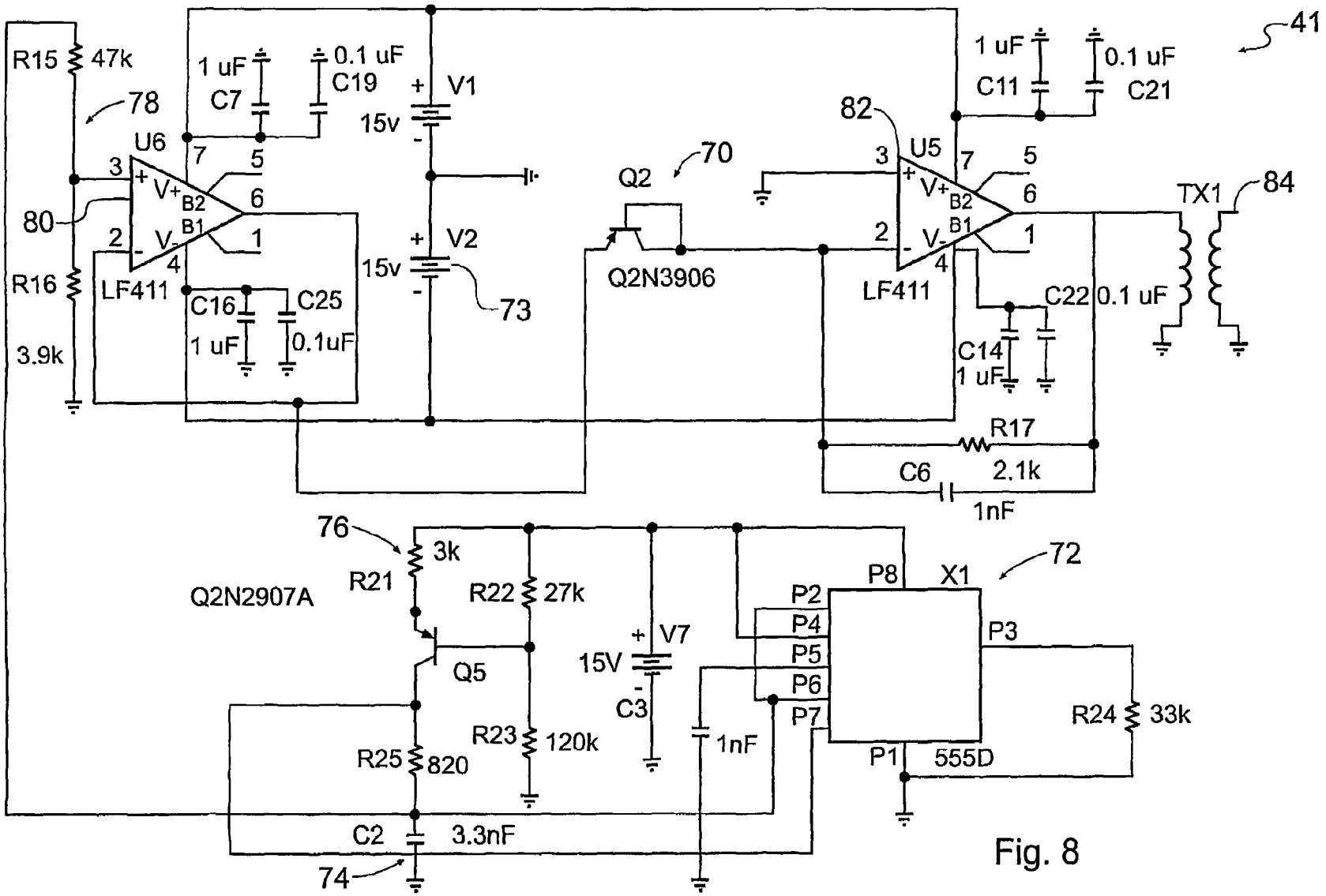
FIG. 8 shows a circuit diagram of a drive circuit suitable for the generation of analogue exponential pulses such as the pulse shown in FIG. 5.

FIG. 8 shows a circuit diagram of a drive circuit suitable for the generation of analogue exponential pulses such as the pulse shown in FIG. 5.

The generation of exponential pulses by the drive circuit is based on the forward biased characteristic of a pn junction, which can be written as $I=I_0(\exp(qV/kT)-1)$, where I is the current through the junction, $I_0$ is the junction reverse biased current, q is the charge on an electron ($1.6\times10^{-19}$ Coulombs), k is the Boltzmann constant, T is absolute temperature and V is the voltage across the junction. As long as $\exp(qV/kT)>>1$, the current is truly exponential with voltage. Therefore, an exponential voltage pulse can be produced by converting the junction current to a voltage. The requirement that $\exp(qV/kT)>>1$ sets a lower limit to the voltage across the junction. The upper limit to this voltage is set by the Ohmic voltage drop across any resistance connected in series with the junction, which occurs at high values of the current.

The Ohmic resistance and the reverse current are dependent on the fabrication and design of the pn junction. The emitter-base junction of a transistor is a suitable junction, as is a diode junction. However, a transistor is to be preferred, as its characteristics with regard to the Ohmic resistance and reverse current are superior.

If the voltage applied to the junction is increased linearly with time (t) to give a voltage ramp of the form V=at, then the current will be of the form $I=\exp(t/\tau)$ where $1/\tau$ corresponds to qa/kT. Conversion of this current to a proportional voltage gives an exponential voltage of the form required for operation of the mass spectrometer, namely $V=V_0 \exp(t/\tau)$.

The circuit diagram of FIG. 8 shows a drive circuit 41 having components which can be used to achieve this. The drive circuit 41 is based on a transistor 70 with its base and collector connected together, so that the emitter-base junction of the transistor forms the pn junction of the drive circuit 41. The transistor 70 is selected for the characteristics required to give the desired voltage range, and all the devices in the circuit 41 have a high enough upper frequency limit to follow the exponential voltage change with time.

The circuit 41 uses a timer chip 72 (such as a 555 timer) to develop the linearly increasing voltage ramp which is applied to the transistor 70. The timer chip has eight pins, indicated in FIG. 8 as P1 to P8, with the voltage ramp being obtained at pin P6. The value of the voltage ramp increases from ⅓ of the voltage of voltage supply 73 to ⅔ of this voltage. In this case, voltage supply 73 is 15V, so the voltage ramp changes from 5 V to 10 V.

The value of the voltage proportionality constant a (and hence the slope of the voltage ramp) is determined by the level of charging current entering capacitor 74. This is in turn determined by the value of resistor 76. A voltage divider 78 is provided to reduce the range of the voltage ramp produced by the timer chip 72 to a range suitable for the pn junction formed by the transistor 70. A first operational amplifier 80 located between the voltage divider 78 and the transistor 70 acts as an impedance matching voltage follower. This amplifier 80 needs to have a sufficiently high slew rate to follow the exponential voltage.

A second operational amplifier 82 converts the junction current to the desired exponential voltage. Finally, a step-up transformer 84 increases the exponential voltage to a level required for operation of the mass spectrometer.

FIG. 8 shows various values for components used in the drive circuit 41. It is to be understood that these values are for the purposes of example only, and that an analogue circuit performing the required function could be constructed from components having other values. Furthermore, it is to be noted that the drive circuit of FIG. 8 is designed for use in a constant temperature environment.

Everything described hereinabove concerns positive ion mass spectrometers. Negative ion mass spectrometry is less commonly employed but the principles of the present invention can equally well be applied to negative ions. In such a case, the polarities of the electric fields described herein would need to be reversed, including use of a positive going exponential pulse.

A further embodiment uses a positive going exponential pulse to provide a mass filter for positive ions. The pulse is applied to the first electrode of the exponential box (the first mass filter electrode 38 in FIGS. 2 and 4). This is in contrast with the embodiments already described, in which the exponential pulse is applied to second electrode of the exponential box (the exponential pulse electrode 40 in FIGS. 2 and 4) and the first electrode is grounded. However, the grounding of the first electrode in these embodiments serves to prevent the build-up of space charge arising from the ions deflected by the second ion repeller electrode 36. Therefore, if a positive going pulse is applied to the first electrode of the exponential box to filter positive ions, an additional electrode which is grounded should be provided upstream of the exponential box to collect deflected ions.

Additionally, negative ions could be filtered by applying a negative going pulse to the first electrode of the exponential box.

REFERENCES

[1] WO 83/00258

[2] "Enhancement of ion transmission at low collision energies via modifications to the interface region of a 4-sector tandem mass-spectrometer", Yu W., Martin S. A., *Journal of the American Society for Mass Spectronomy,* 5(5) 460-469 May 1994

[3] "Advances in multidetector arrays for mass-spectroscopy—A LINK (JIMS) Project to develop a new high-specification array", Birkinshaw K., *Transactions of the Institute of Measurement and Control,* 16(3), 149-162, 1994

[4] "Focal plane charge detector for use in mass spectroscopy", Birkinshaw K., *Analyst,* 117(7), 1099-1104, 1992

Appendix

Mathematical Treatment of the Principle of Operation of the Exponential Box

Assumptions:

(i) The ion packet is positioned exactly at the entrance of the exponential box at the start of the exponential voltage pulse, (ii) the ion packet width is negligible with respect to the length of the exponential box so that all ions have the same path length within the box, and (iii) all ions have axial velocity components of zero at the start of the exponential pulse.

The foregoing simplifications do not have to be made and the effect of taking these factors into account is, in general terms, to degrade the resolution of the exponential box filter. This simplified theory explains the underlying principles of operation, however.

For an ion of mass m and velocity v the ion kinetic energy, $E_{ion}$, is given by:

$$E_{ion} = \frac{mv^2}{2} \tag{1}$$

As can be seen, if all ions are given the same velocity in the exponential box then the ion mass is simply proportional to the ion energy. Measuring the ion energy is intrinsically simpler than the velocity selection method commonly used in mass spectrometers (where all ions have the same kinetic energy).

If an ion has a (positive) charge of q and it is placed in an electric field E, between two electrodes, then it will experience an instantaneous force, equal to the product Eq, that will cause it to accelerate towards the negative electrode. From Newton's second law of motion the ion will be accelerated at a rate that is inversely proportional to the ion mass:

$$\frac{d^2 s}{dt^2} = \frac{Eq}{m} \tag{2}$$

where s is distance travelled towards the negative electrode and t is the time for which the field was applied.

If a voltage V is applied across two electrodes that are spaced d apart, then the resulting field E is given by:

$$E=V/d \tag{3}$$

In the case of the exponential box, the voltage is time dependent and the instantaneous voltage $V_t$ is increasing exponentially with time:

$$V_t = V_0 \exp\left(\frac{t}{\tau}\right) \tag{4}$$

where $V_0$ is the voltage at t=0 and $\tau$ is the exponential time constant.

Combining equations (2), (3) and (4) gives:

$$\frac{d^2 s}{dt^2} = \frac{qV_0}{dm} \exp\left(\frac{t}{\tau}\right) \tag{5}$$

The instantaneous velocity $v_t$ can be obtained by integration of equation (5) with respect to t:

$$v_t = \int_0^t \frac{d^2 s}{dt^2} dt = \int_0^t \frac{qV_0}{dm} \exp\left(\frac{t}{\tau}\right) dt \tag{6}$$

or $$v_t = \frac{\tau q V_0}{dm} \exp\left(\frac{t}{\tau}\right) + C \tag{7}$$

The distance travelled by the ion, $s_t$, after time t is obtained by integrating equation (7):

$$s_t = \int_0^t v_t dt = \frac{\tau^2 q V_0}{dm} \exp\left(\frac{t}{\tau}\right) + Ct + C' \tag{8}$$

Assuming the constants of integration Ct and C to be zero equation (8) simplifies to:

$$s_t = \frac{\tau^2 q V_0}{dm} \exp\left(\frac{t}{\tau}\right) \tag{9}$$

If the exponential pulse time, t, and inter-electrode gap, d, are arranged so that $s_t$=d, then, after rearrangement, equation (9) becomes:

$$V_0 \exp\left(\frac{t}{\tau}\right) = \frac{md^2}{\tau^2 q} \tag{10}$$

Now, substituting for $V_0\exp(t/\tau)$ from equation (10) into equation (7), and noting that the constant of integration is zero in this simplified treatment, $v_t$ is found to be independent of the ion mass:

$$v_t = \frac{d}{\tau} \tag{11}$$

Hence it has been shown that, when the ion exits the exponential box, its velocity is only dependent on the length of the exponential box, d, and the exponential pulse time constant, $\tau$. In other words, all ions will have the same velocity irrespective of their masses.

The invention claimed is:

1. A mass spectrometer comprising:

an ion source for providing an ion beam comprising a plurality of ions of more than one mass-to-charge ratio;

an ion detector arranged to receive the ion beam and operable to detect the ions according to their mass-to-charge ratios; and a mass filter arranged between the ion source and the ion detector, the mass filter comprising an electrode arrangement and a drive circuit, the drive circuit being configured to apply a time varying voltage profile to the electrode arrangement so as to accelerate the plurality of ions so that they leave the mass filter with nominally equal velocities irrespective of their mass-to-charge ratios.

2. A mass spectrometer according to claim 1, wherein the time varying voltage profile comprises an exponential voltage pulse.

3. A mass spectrometer according to claim 1, wherein the time varying voltage profile comprises a sequence of voltage pulses having an exponentially increasing repetition frequency.

4. A mass spectrometer according to claim 3, wherein the voltage pulses have substantially equal amplitude.

5. A mass spectrometer according to claim 1, wherein the drive circuit is an analogue drive circuit.

6. A mass spectrometer according to claim 5, in which the analogue drive circuit comprises a low voltage analogue circuit and a step-up transformer.

7. A mass spectrometer according to claim 1, wherein the drive circuit is a digital drive circuit.

8. A mass spectrometer according to claim 7, in which the digital drive circuit comprises two or more digital wave form generators connected in parallel.

9. A mass spectrometer according to claim 1, in which the ion source comprises a pulse generator for generating the ion beam as a series of packets.

10. A mass spectrometer according to claim 1, in which the ion detector comprises a detector element and an ion disperser to disperse the ions over the detector element according to their mass-to-charge ratios.

11. A mass spectrometer according to claim 10, wherein the detector element is a detector array.

12. A mass spectrometer according to claim 10, wherein the detector element is a single element detector.

13. A mass spectrometer according to claim 11, further comprising a slit arranged in front of the ion detector, wherein the ion disperser is operable to route ions through the slit according to their mass-to-charge ratios.

14. A mass spectrometer according to claim 1, in which the ion detector comprises a first detector electrode, a second detector electrode and a voltage supply operable to bias the first and second detector electrodes with a summation of the time varying voltage profile applied to the electrode arrangement of the mass filter and a bias voltage $V_r$ sufficient to reject ions having an energy of less than $V_r$ electron volts.

15. A mass spectrometer according to claim 1, in which the ion detector comprises a first detector electrode and a voltage supply operable to bias the first detector electrode with a summation of the time varying voltage profile applied to the electrode arrangement of the mass filter and a bias voltage $V_r$ sufficient to reject ions having an energy of less than $V_r$ electron volts.

16. A method of accelerating ions within a mass spectrometer, the method comprising:

generating an ion beam comprising a plurality of ions of more than one mass-to-charge ratio;

supplying the beam of ions in packets to a mass filter region defined by an electrode arrangement; and applying a time varying voltage profile to the electrode arrangement so as to accelerate the plurality of ions passing through the mass filter region so that they leave the mass filter region with nominally equal velocities irrespective of their mass-to-charge ratios.

17. A method according to claim 16, wherein the time varying voltage profile comprises an exponential voltage pulse.

18. A method according to claim 16, wherein the time varying voltage profile comprises a sequence of voltage pulses having an increasing repetition frequency.

19. A method according to claim 18, wherein the voltage pulses have substantially equal amplitude.

20. A mass filter, comprising an electrode arrangement and a drive circuit, the drive circuit being configured to apply a time varying voltage profile to the electrode arrangement so as to accelerate a plurality of ions of more than one mass-to-charge ratio passing through the mass filter so that they leave the mass filter with nominally equal velocities irrespective of their mass-to-charge ratios.

21. A mass filter according to claim 20, wherein the time varying voltage profile comprises an exponential voltage pulse.

22. A mass filter according to claim 20, wherein the time varying voltage profile comprises a sequence of voltage pulses having an increasing repetition frequency.

* * * * *